United States Patent [19]

Matsuno et al.

[11] Patent Number: 5,018,718

[45] Date of Patent: May 28, 1991

[54] SHEET REGISTRATION METHOD AND APPARATUS FOR CALCULATION OF DELAY TIME AND SHEET FEED CONTROL THEREBY

[75] Inventors: Junichi Matsuno, Toride; Tsuyoshi Ogasawara, Ibaraki; Masataka Kawauchi, Ishioka; Yasuyuki Tsuji, Katsuta, all of Japan

[73] Assignees: Hitachi, Ltd. & Hitachi Koki Co., Ltd., both of Tokyo, Japan

[21] Appl. No.: 457,854

[22] Filed: Dec. 27, 1989

[30] Foreign Application Priority Data

Dec. 28, 1988 [JP] Japan ..... 63-334786

[51] Int. Cl.[5] ..... B65H 9/04; G03G 21/00

[52] U.S. Cl. ..... 271/245; 271/227; 271/270; 355/317

[58] Field of Search ..... 355/204, 208, 308, 309, 355/316, 317, 77; 271/227, 245, 270

[56] References Cited

U.S. PATENT DOCUMENTS

| | | | |
|---|---|---|---|
| 3,930,725 | 1/1976 | Jones et al. | 355/317 X |
| 4,025,187 | 5/1977 | Taylor et al. | 355/317 |
| 4,416,534 | 11/1983 | Kluger | 355/317 |
| 4,519,700 | 5/1985 | Barker et al. | 271/270 X |

*Primary Examiner*—A. T. Grimley
*Assistant Examiner*—J. E. Barlow, Jr.
*Attorney, Agent, or Firm*—Antonelli, Terry, Stout & Kraus

[57] ABSTRACT

A method of controlling print positioning comprises the steps of: detecting the time which elapses until a sheet of paper reaches a given position; predicting the time which would elapse until the paper reaches an image transfer position on the basis of the time detected in the detection step; calculating the time difference between the predicted time and an elapse time calculated on the basis of a paper carrying speed pattern which is previously stored and has at least two speeds; and controlling the paper carrying speed so that the calculated time difference becomes zero, thereby preventing any misregistration between a toner image and the paper.

15 Claims, 5 Drawing Sheets

SHEET REGISTRATION METHOD AND APPARATUS FOR CALCULATION OF DELAY TIME AND SHEET FEED CONTROL THEREBY

BACKGROUND OF THE INVENTION

The present invention relates to print positioning in an apparatus for carrying cut paper for a copying machine, or printer, and particularly to a method and apparatus for controlling print positioning which is suitable for a paper-carrying apparatus requiring high speed and high precision as such relates to a printer. Conventional methods of controlling print positioning, for example, the method disclosed in Japanese Patent Unexamined publication No. 58-144036, employs a printer comprising a photosensitive body carrying a toner image, a charged body for transferring the toner image to paper, a paper end-positioning member for temporarily stopping the paper carried, and carrying rollers for carrying the paper to a transfer portion after the paper end positioning member has been released. The paper end-positioning member is opened and closed to prevent any printing misregistration between the toner image and the paper, and the paper is then held between the carrying rollers and carried at the circumferential speed of the photosensitive drum.

In such a conventional method of controlling print positioning, no consideration is given to the printing misregistration caused by variation in the time period which elapses from the release of the paper end positioning member to the holding of the paper between the carrying rollers, and there is a critical problem in that such error in print position cannot be ignored in a high-speed printer.

SUMMARY OF THE INVENTION

It is an object of the present invention to provide a method and an apparatus for controlling print positioning which are capable of achieving the positioning of a paper end with high precision in a high-speed printer.

It is another object of the present invention to provide a printer in which an apparatus for controlling print positioning is incorporated.

In order to achieve these ends, a method of controlling print positioning according to the present invention employs a printer comprising a photosensitive body which carries a toner image, a charged body for transferring the toner image to paper, a paper end positioning member for temporarily stopping the paper carried, and carrying means for carrying the paper to a transfer portion after the paper end positioning member has been released. The method comprises the steps of detecting the time which elapses until the paper reaches a given position, predicting the time which elapses until the paper reaches the transfer portion on the basis of the time detected in the detecting step, calculating a time difference between the predicted time and a set time which is based on predicted time and a carrying speed pattern which is previously stored and has at least two speeds, and controlling the carrying speed of the carrying means so that the time difference becomes zero before the paper reaches the transfer portion.

An apparatus for controlling print positioning according to the present invention comprises detecting means for detecting the time which elapses until a paper end reaches a given position, calculating means for calculating a time delay relative to the set time in the carriage of the paper on the basis of an output signal from the detecting means, and control means for controlling the carrying speed of the carrying means on the basis of an output signal from the calculating means.

The printer according to the present invention comprises a photosensitive body which carries a toner image, a charged body for transferring the toner image to paper, a paper end positioning member for temporarily stopping the paper carried and carrying means for carrying the paper to a transfer portion after the paper end positioning member has been released. The printer is further provided with an apparatus for controlling print positioning which apparatus comprises detecting means for detecting the time which elapses until the paper end reaches a given position, calculating means for calculating a time delay in the time set for the carriage of the paper on the basis of an output signal from the detecting means, and control means for controlling the carrying speed of the carrying means on the basis of an output signal from the calculating means.

The method of controlling print positioning according to the present invention comprises the steps of detecting the time which elapses until a sheet of paper is held between carrying means, predicting the time which elapses until the paper reaches a transfer portion, calculating a time difference between the time which elapses and a set time based on the ideal carrying speed pattern and controlling the carrying speed of the carrying means so that the time difference becomes zero before the time the paper reaches the transfer portion. That is, after the paper has been held between the carrying means, the control of the carrying speed is adjusted before the paper reaches the transfer portion, and the paper is then carried at a speed equal to the circumferential speed of the photosensitive body, whereby any deviation in the carrying speed of the paper and misregistration between the paper and the toner image can be eliminated.

DESCRIPTION OF THE PREFERRED EMBODIMENTS

Figure 1:
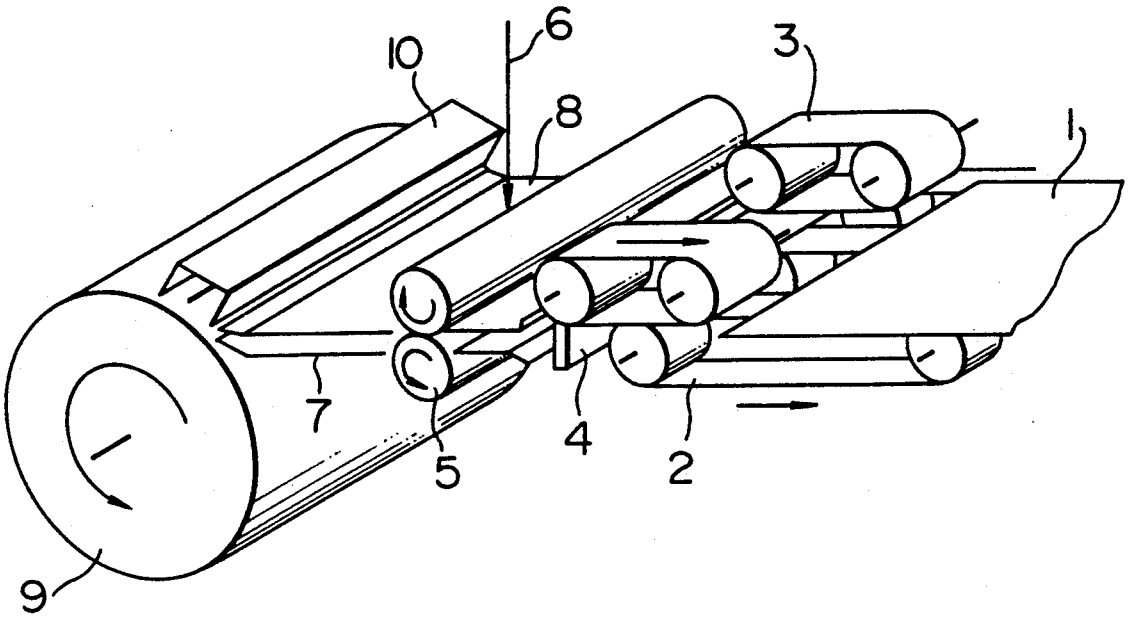
FIG. 1 is a perspective view partly showing a printer provided with an apparatus for controlling print positioning according to an embodiment of the present invention.

FIG. 1 shows a printer provided with an apparatus for controlling print positioning according to an embodiment of the present invention. The printer comprises carrying belts 2 for carrying paper 1 which is separated sheet by sheet by a paper separating unit (not shown), resist belts 3, a paper end positioning member, i.e., a stopper 4, fixed to the resist belts 3 for temporarily stopping the paper 1, carrying means, i.e., a pair of carrying rollers 5, for carrying the paper 1 to a transfer portion after the stopper 4 is released, at least one sensor 6 for detecting one end of the paper 1 carried after the stopper 4 is released, lower guide plate 7 and an upper guide plate 8, a photosensitive drum 9 which carries a toner image (not shown), and a charged body, i.e., a transfer corotron 10, for transferring the toner image to the paper 1.

The carrying belts 2 are rotated at a given speed by being driven by a pair of rollers which are rotatably supported by side plates. (not shown) A pair of rollers for driving the resist belts 3 ar rotatably supported by side plates (not shown) and are driven by a resist driving motor 11 (see FIG. 8). After one end of the paper 1 abuts against the stopper 4, the stopper 4 is driven to permit timing which allows the toner image on the photosensitive drum 9 to coincide with arrival of the paper 1. The pair of carrying rollers 5 are rotatably supported by the side plates (not shown) are are rotated by a carrying roller driving motor 12 (refer to FIG. 8), at a speed which can be controlled.

Figure 8:
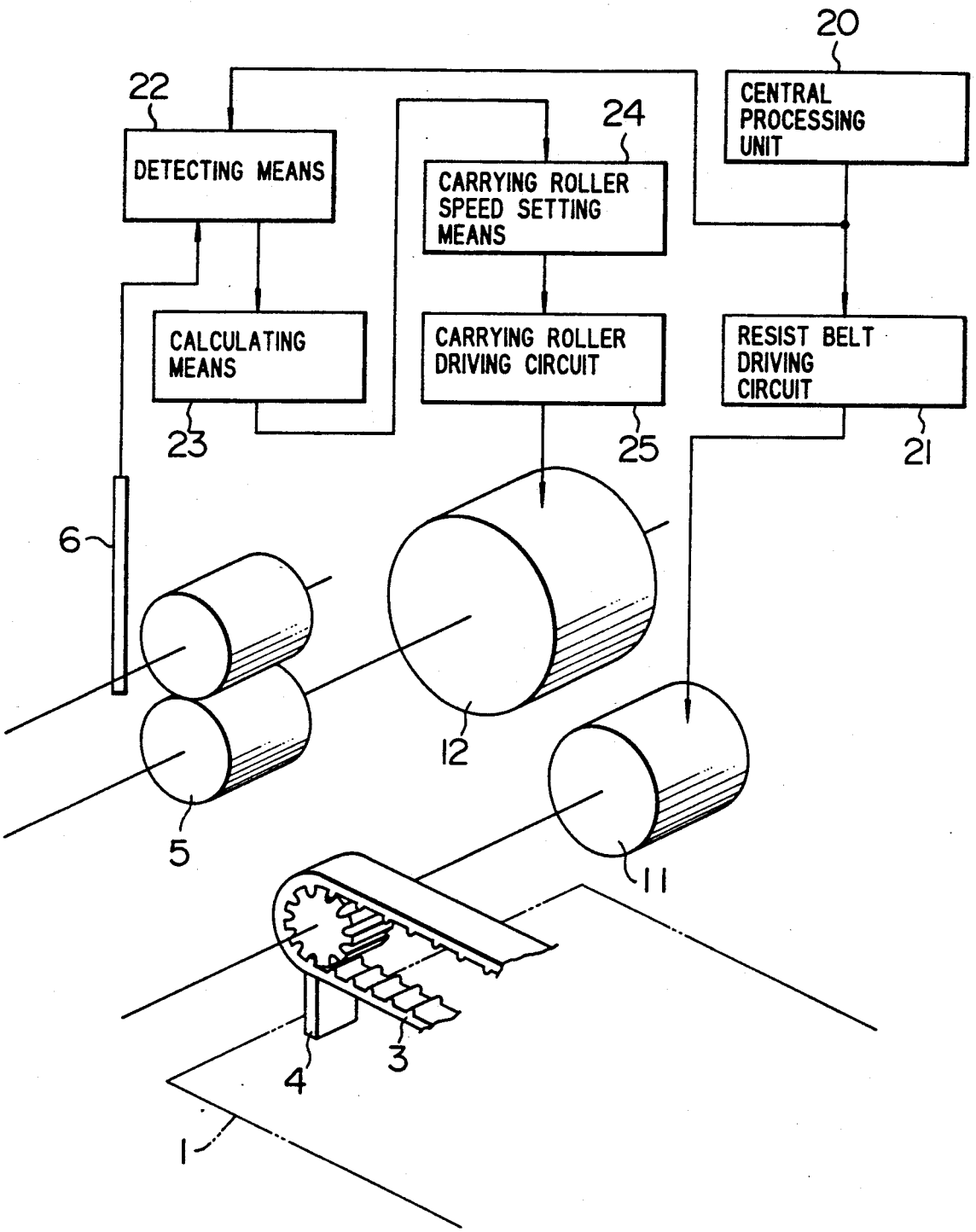
FIG. 8 is a perspective view of an apparatus for controlling print positioning and a part of the printer.

Referring to FIG. 8, the apparatus for controlling print positioning comprises a central processing unit 20, a resist belt driving circuit 21 for actuating a resist driving motor 11 using as a trigger an output signal from the central processing unit 20, at least one sensor 6 for detecting one end of the paper 1, detecting means 22 for determining the time which elapses until the sensor 6 detects the end of the paper 1 after the stopper 4 is released, calculating means 23 for calculating the delay in the carrying of the paper 1 on the basis of the output signal from the detecting means 22, carrying roller speed setting means 24 for setting the rotational speed of the carrying roller driving motor 12 on the basis of an output signal from the calculating means 23 and a carrying roller driving circuit 25.

Figure 2:
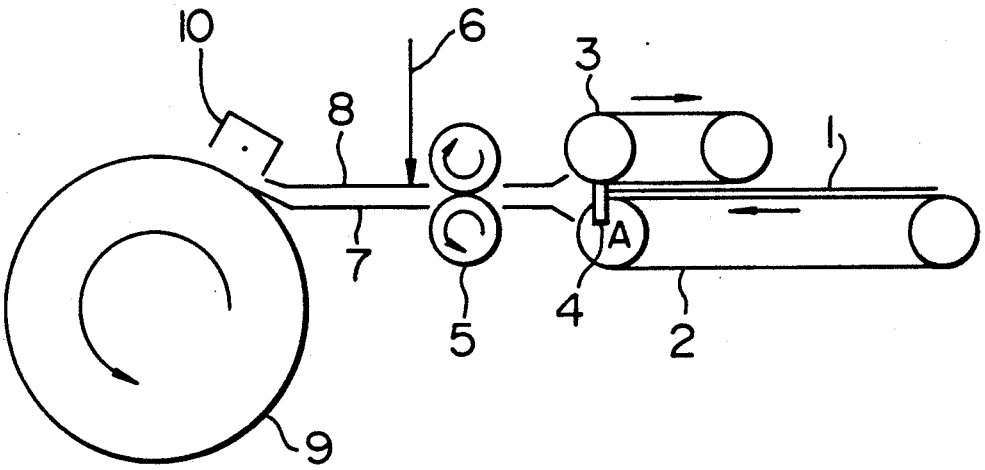
FIGS. 2 to 5 are side views of the printer shown in FIG. 1 with paper at different positions.

In operation, the paper 1 is separated from other paper by a paper separating unit (not shown) and then placed on the carrying belts 2 to be carried, as shown in FIG. 1. The paper 1 is resisted (temporarily stopped) by the stopper 4 which positions the paper 1 at a home position A, as shown in FIG. 2. Since the carrying belts 2 are always driven at a constant speed, the paper 1 slides on the surfaces of the carrying belts 2 while the paper 1 is resisted (temporarily stopped) with one end in contact with the stopper 4.

Figure 3:
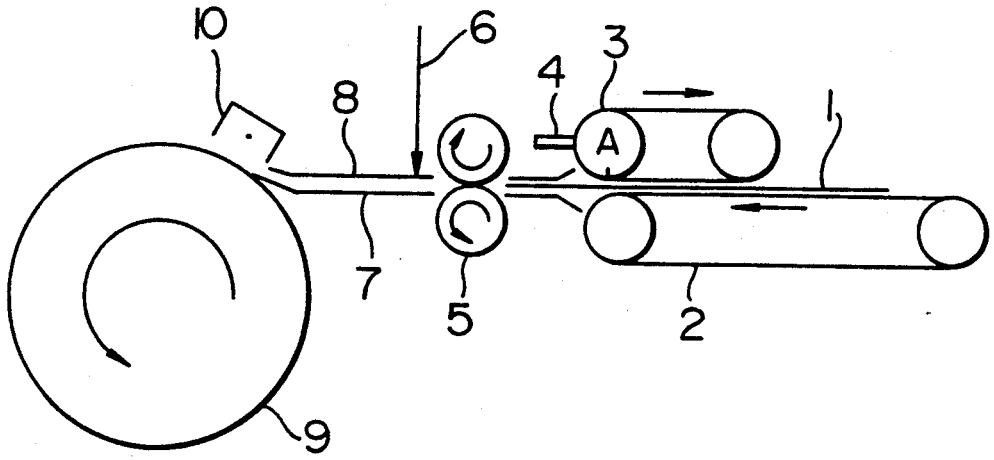
Figure 4:
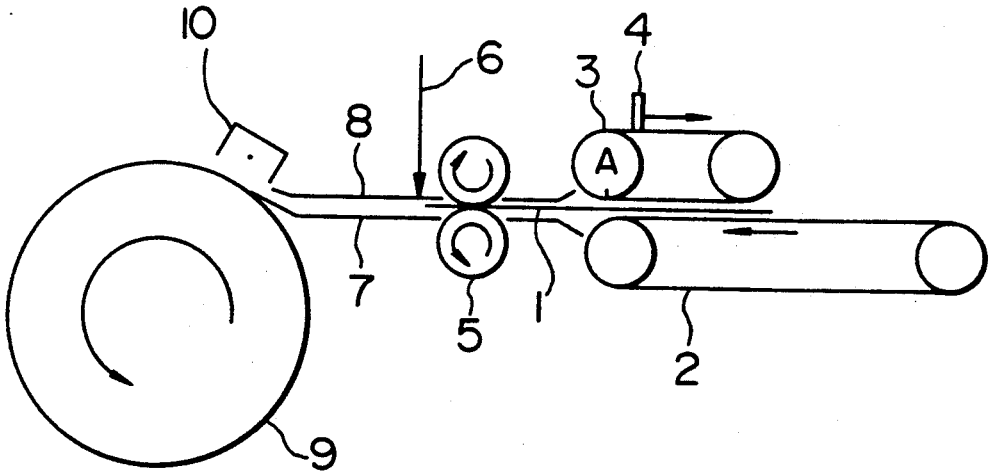

The resist belts 3 are then driven with timing which allows a toner image on the drum 9 to coincide with the paper 1, and the stopper 4 fixed to the resist belts 3 is than released, as shown in FIG. 3. More specifically, the resist belts 3 are driven to release the stopper 4 at a time which allows the time elapsing until the paper 1 reaches the position below the transfer corotron 10 to agree with the time elapsing until the toner image on the drum 9 reaches the position below the transfer corotron 10. The paper 1 is again carried by the carrying belts 2, as shown in FIG. 3, and held between the carrying rollers 5, as shown in FIG. 4.

It is to be noted that during the time which elapses until the paper 1 is held between the carrying rollers 5 after it is released from the stopper 4, the paper 1 is carried by friction between the paper 1 and the surfaces of the carrying belts 2 and there is a deviation in the time elapsing from the release of the paper 1 from the stopper 4 to the holding between the carrying rollers 5 since there is sliding between the paper 1 and the surfaces of the carrying belts 2.

Figure 5:
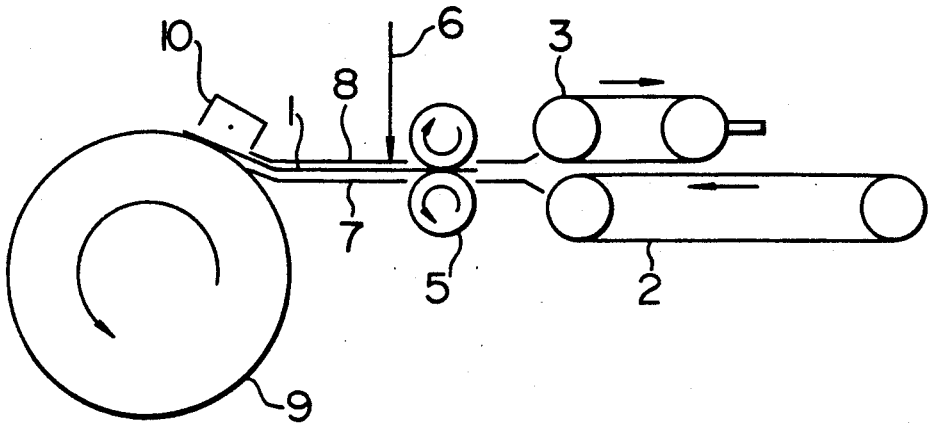

After the paper 1 is held between the carrying rollers 5, there is no sliding between the paper 1 and the carrying rollers 5. That is, the carrying speed of the paper 1 is determined by the rotational speed of the carrying rollers 5. The sensor 6 disposed immediately downstream from the carrying rollers 5 for detecting the end of the paper 1 detects the end of the paper 1, as shown in FIG. 4. The paper 1 carried by the carrying rollers 5 is guided by the lower guide plate 7 and the upper guide plate 8 and brought into contact with the drum 9 in the position below the transfer corotron 10, as shown in FIG. 5. The toner image is then transferred to the paper 1 owing to the potential difference produced by the transfer corotron 10.

Figure 6:
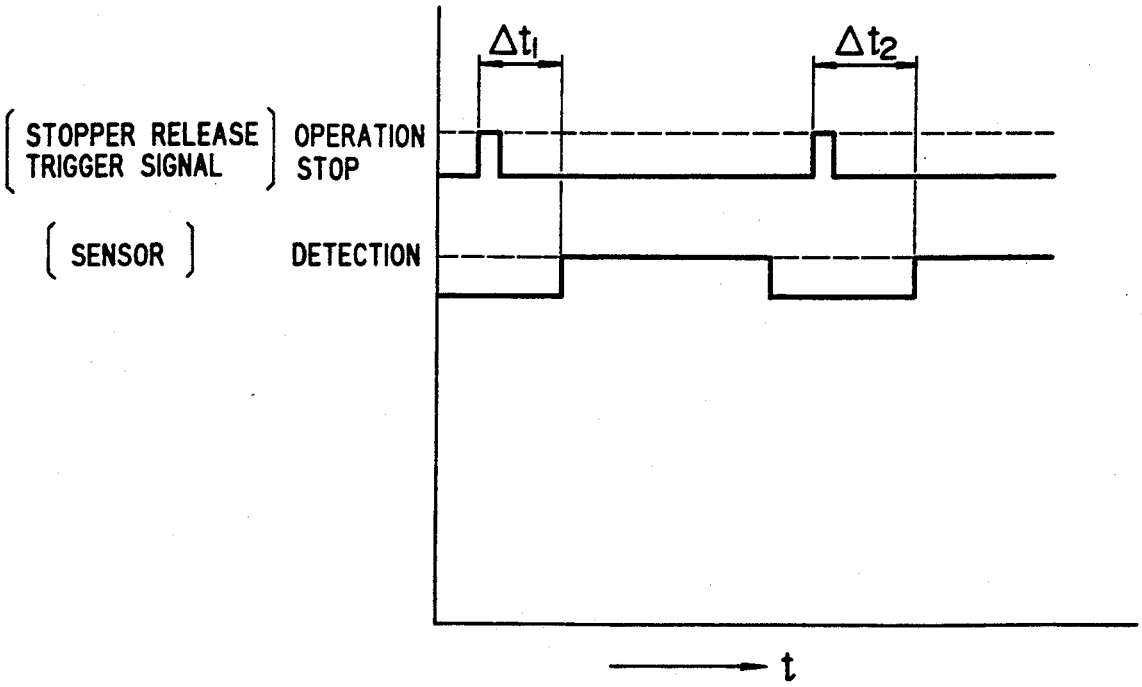
FIG. 6 is a drawing showing the output states of a central processing unit and a sensor.

Referring to FIG. 6, a time relationship $\Delta t_n$ between the trigger signal from the central processing unit 20 for releasing the stopper 4 and an output signal from the sensor 6 is shown. The time $\Delta t_n$ from the rising of the signal for releasing the stopper 4 to detection of the end of the paper 1 by the sensor 6 varies for the above-described reason. If the friction between the paper 1 and the surfaces of the carrying belts 2 were increased so that no sliding occurs therebetween, the paper 1 would wrinkle when the paper 1 is stopped by the stopper 4, and it would thus be impossible to satisfy the resist function of the stopper 4. Namely, in order to temporarily stop the paper 1 by the stopper 4 while being carried, it is preferable that the friction between the paper 1 and the surfaces of the carrying belts 2 not be excessively large. However, this causes an increase in variance of the carrying speed of the paper 1, and this variance causes misplacement between the paper 1 and the toner image which degrades precision of the print positioning. It is therefore necessary to remove such variance in the paper 1 reaching the transfer corotron 10.

Figure 7:
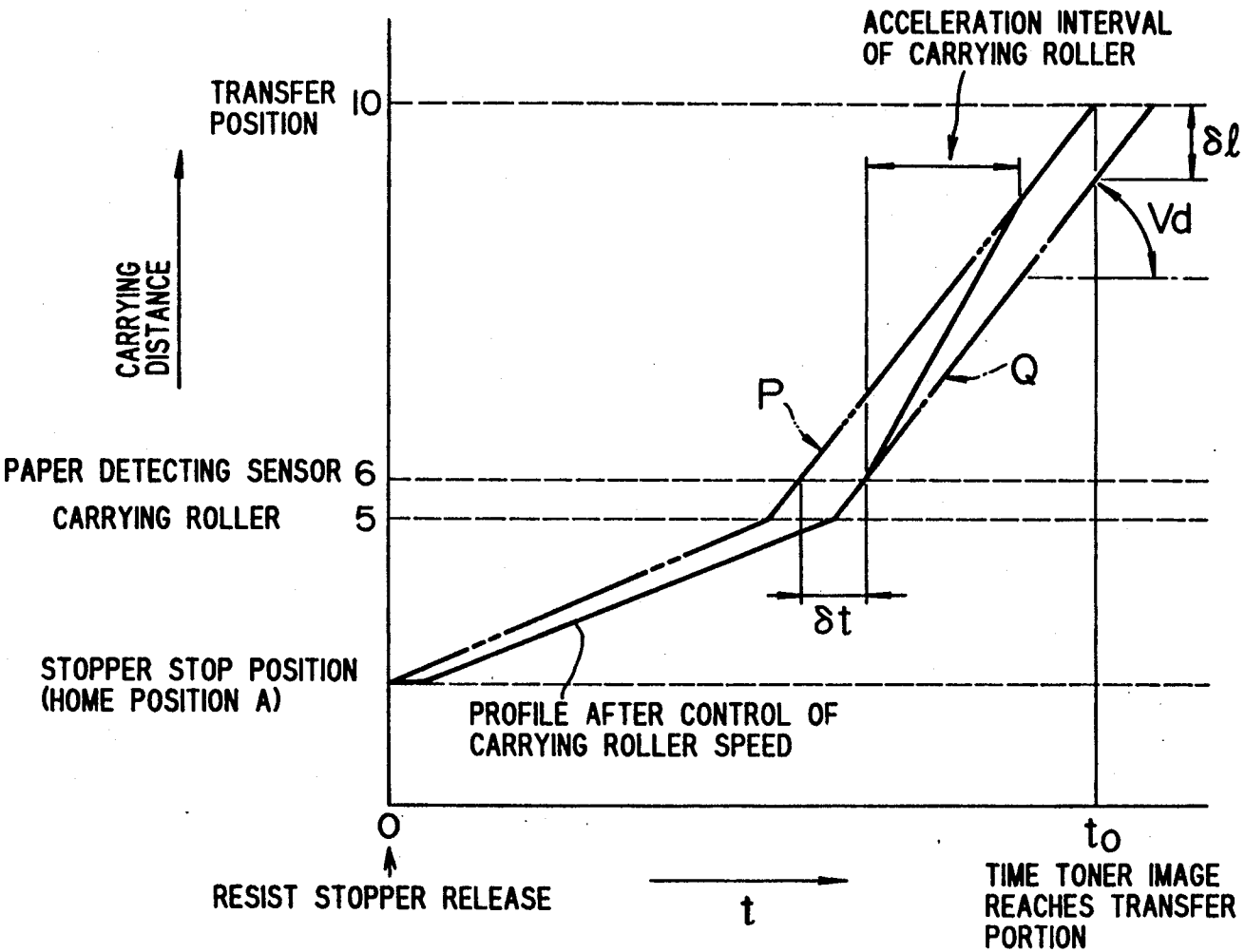
FIG. 7 is a graph showing carrying speed pattern for paper.

Referring to FIG. 7, the relationship between the time t and the carrying distance in the control method for removing time variance which degrades the precision of the printing position is shown. In the drawing, a carrying speed pattern (carrying profile) P for the paper 1 having at least two speeds is shown by a two-dot chain line. If the paper 1 is carried by the carrying belts 2 in accordance with the ideal carrying profile P and, the carrying rollers 5 are rotated at the same speed as the circumferential speed of the drum 9, the positioning of the toner image and the paper 1 agree with each other at the position below the corotron 10. However, since time variance described above occurs in fact, the paper 1 is carried in accordance with the carrying profile Q shown by a solid line and a one-dot chain line, thereby producing a deviation $\delta l$ in the print position. In order to remove the deviation $\delta l$ in the print position, the time difference $\delta t$ between-the time when the paper 1 passes the sensor 6 in the carrying profile Q and the carrying profile P is calculated. On the basis of the result of the carrying rollers 5 is increased so that the time difference, i.e., the delay $\delta t$ is recovered before the paper 1 reaches the position of image transfer, and transfer is performed at a rotational speed $V_d$ of the carrying rollers 5 which is again set so as to be the same as the circumferential speed of the drum 9.

The control of the speed of the carrying rollers 5 is described below with reference to FIG. 8. That is, the resist driving motor 11 is started using the resist belt driving circuit 21 by a trigger signal from the central processing unit 20 which is created from a signal caused by a electrostatic latent image recorded on the photosensitive body. At the same time, the trigger signal from the central processing unit 20 is transmitted to the detecting means 22. The detection means 22 uses as a trigger this signal to determine the time which elapses from the release of the paper 1 from the stopper 4 to the detection by the sensor 6. The calculating means 23 calculates a time delay time from the reference time based on the ideal carrying profile P. The result of the calculation is sent to the carrying roller speed setting means 24 for setting the speed of the carrying rollers 5 by which the speed of the carrying rollers 5 is set so that the delay δt is recovered. By using the command value of the speed, the carrying roller driving motor 12 is rotated by the carrying roller driving circuit 25 to carry the paper 1.

Since the method of controlling print positioning according to the present invention is capable of correcting with high precision the small error produced in the timing of the passage of the paper when the paper is temporarily stopped, the method has the effect of enabling print positioning at high speed with high precision. Further, since the timing of the passage of the paper is controlled immediately before the transfer position, the method also has the effect of preventing the positioning from being easily affected by external disturbance.

What is claimed is:

1. A method of controlling print positioning to prevent misregistration between a toner image and paper in a printer including transfer means for transferring said toner image to paper, a paper end positioning member for temporarily stopping movement of said paper, and carrying means for carrying said paper to an image transfer position after said paper end positioning member is released, said method comprising the steps of: (a) detecting the time which elapses until said paper reaches a given position; (b) predicting the time which would elapse until said paper reaches said image transfer position on the basis of the time detected in detecting step (a); (c) calculating a time difference between the time from said predicting time step (b) and a time determined on the basis of a carrying speed pattern which is previously stored and has at least two speeds; and, (d) controlling the carrying speed of said carrying means so that said time difference becomes zero to have said paper reach said image transfer position for image positioning on said paper without misregistration.

2. A method of controlling print positioning according to claim 1, wherein in said detecting step (a) the time from the passage of said paper through said paper end positioning member to the arrival of said paper at said given position is detected.

3. A method of controlling print positioning according to claim 1 to 2, wherein in said predicting step (b) the time from the passage of said paper through said paper end positioning member to the arrival at said image transfer position is predicted.

4. A method of controlling print positioning according to any one of claims 1 or 2, wherein said detecting step (a) is started by an output signal from said central processing unit, said output signal being also used as a trigger for driving said paper end positioning member.

5. A method of controlling print positioning according to claim 3, wherein said detecting step (a) is started by an output signal from said central processing unit, said output signal being also used as a trigger for driving said paper end positioning member.

6. An apparatus for controlling print positioning comprising detecting means for detecting the time which elapses until one end of paper reaches a given position, calculating means for calculating a time delay in the carrying of said paper, relative to a time set on the basis of an output signal from said detecting means, and control means for controlling the carrying speed of paper carrying means on the basis of an output signal from the calculating means.

7. An apparatus for controlling print positioning according to claim 6 further comprising a central processing unit and a resist belt driving circuit for driving a paper end positioning member, said control means further comprising means for setting the carrying speed of said paper carrying means and a carrying means driving circuit provided in said carrying means.

8. An apparatus for controlling print positioning according to claim 7, said detecting means and said resist belt driving circuit are actuated by using an output trigger the output signal from said central processing unit.

9. An apparatus for controlling print positioning according to claim 7 or 8, wherein said paper end positioning member comprises at least one stopper fixed to resist belts for temporarily stopping or releasing said paper.

10. An apparatus for controlling print positioning according to claim 9, wherein said detecting means comprises at least one sensor for detecting one end of said paper carried when said stopper is released, and said calculating means calculates a time delay, from when said paper is released until said paper would reach an image transfer position, on the basis of the signal output from said sensor.

11. A printer having a photosensitive body which carries a toner image, a charged body for transferring said toner image to paper, a paper end positioning member for temporarily stopping carrying of said paper, and carrying means for carrying said paper to an image transfer position after said paper end positioning member is released, said printer being provided with an apparatus for controlling print positioning which apparatus comprises detecting means for detecting a time which elapses until one end of said paper reaches a given position, calculating means for calculating a time delay in the carrying of said paper, relative to a set time on the basis of an output signal from said detecting means, and control means for controlling the carrying speed of said carrying means on the basis of the output signal from said calculating means.

12. A printer according to claim 11, wherein said apparatus for controlling print positioning further comprises a central processing unit and a resist belt driving circuit for driving said paper end positioning member, and said control means further comprises means for setting the carrying speed of said carrying means and a carrying means driving circuit provided in said carrying means.

13. A printer according to claim 12, wherein said detecting means and said resist belt driving circuit are actuated by using an output trigger signal from said central processing unit.

14. A printer according to claim 12 or 13, wherein said paper end positioning member comprises at least one stopper fixed on resist belts for temporarily stopping or releasing said paper.

15. A printer according to claim 12, wherein said detecting means comprises at least one sensor for detecting one end of said paper carried when released from said stopper, and said calculating means calculates a time delay, from when said paper is released until said paper reaches said image transfer position, on the basis of the output signal from said sensor.

* * * * *